United States Patent [19]

Aizawa

[11] 4,181,390

[45] Jan. 1, 1980

[54] SOCKET TERMINALS FOR A WEDGE BASE ELECTRIC LAMP

[75] Inventor: Masanobu Aizawa, Yokohama, Japan

[73] Assignee: Stanley Electric Co., Ltd., Tokyo, Japan

[21] Appl. No.: 940,157

[22] Filed: Sep. 6, 1978

[30] Foreign Application Priority Data

Apr. 4, 1978 [JP] Japan ..... 53/43834[U]

[51] Int. Cl.[2] ..... H01R 33/06

[52] U.S. Cl. ..... 339/65; 339/176 L

[58] Field of Search ..... 339/17 D, 59 L, 65, 339/66 T, 176 L

[56] References Cited

U.S. PATENT DOCUMENTS 3,017,599 1/1962 Loesch ..... 339/176L 3,936,131 2/1976 Durand ..... 339/176 L

FOREIGN PATENT DOCUMENTS 1326008 8/1973 United Kingdom ..... 339/176 L

*Primary Examiner*—Neil Abrams

*Attorney, Agent, or Firm*—Frishauf, Holtz, Goodman and Woodward

[57] ABSTRACT

The present invention relates to socket terminals for a socket into which a wedge base electric lamp is inserted. The socket terminals have a pair of spring portions positioned upwardly of a pair of contact members so that even if lead wires in the electric lamp are not properly bent, the lead wires may be corrected to their proper positions when the electric lamp is inserted into the socket to insure that the contact members may come into contact with the lead wires. The socket terminals have a connecting member or a clamping member to facilitate connections with external lead wires, printed circuit wiring or external cords.

10 Claims, 4 Drawing Figures

SOCKET TERMINALS FOR A WEDGE BASE ELECTRIC LAMP

BACKGROUND OF THE INVENTION

The present invention relates to socket terminals for a socket, into which a wedge base electric lamp is to be inserted. A wedge base lamp is a special electric lamp designed so that lead wires taken out from a sealed portion or the bottom of a so-called wedge portion in the electric lamp are respectively bent in opposite directions.

Generally, wedge base electric lamps are extensively employed because of their ease of manufacture since it is unnecessary to provide a base. A socket for receiving the wedge base electric lamp houses socket terminals serving to retain the electric lamp and to provide contact with lead wires of the electric lamp. The electric lamp is energized when the socket terminals come into contact with the lead wires. However, prior art socket terminals are suffered from various disadvantages noted below. Since the socket terminals are formed into a flat configuration for the purposes of merely retaining the electric lamp and providing contact between the terminals and the lead wires, the lead wires of the electric lamp are not properly bent or the lead wires are bent during the transportion of the electric lamps, for example. As a consequence, if the wedge base electric lamp with the lead wires not properly positioned is inserted into the socket, it fails to obtain a positive contact between the socket terminals and the lead wires. Particularly in the case where the lead wires are one-sided towards an exhaust tube of the wedge base, inferior contact would likely occur resulting in the lamps non-operation or its flickering as a result of minor vibration from the exterior.

The present invention overcomes these prior art disadvantages noted above and provides improved socket terminals. More specifically, the present invention provides socket terminals in which even if lead wires exiting at the wedge base portion of an electric lamp are not properly bent, the lead wires may be maintained in normal position when the electric lamp is fixedly inserted into the socket.

OBJECT OF THE INVENTION

It is a primary object of the present invention to provide improved socket terminals for a wedge base electric lamp wherein when the wedge base electric lamp is fixedly inserted into a socket, contact members of the socket terminals come into positive contact with lead wires of the electric lamp so that upon energization, the lamp operates and no flickering results from external vibrations.

It is another object of the present invention to provide improved socket terminals for a wedge base electric lamp wherein a connecting member is incorporated in an upper end of a socket terminal or a clamping member is incorporated in a lower end of the socket terminal to easily provide connections with external lead wires, printed circuit board wiring or external cords to assure energization of the lamp.

SUMMARY OF THE INVENTION

In the socket terminals for a wedge base electric lamp in accordance with the present invention, there is provided a pair of spring-biased contact members serving as a retained for the electric lamp, above which is a separate pair of inwardly curved spring portions so that even if the lead wires of an electric lamp to be inserted are misaligned, the lead wires may be forcibly corrected to their normal position during the course of insertion of the lamp. This enables one to prevent non-operation and flickering of the lamp resulting from inferior contact between the lead wires of the electric lamp and the contact members of the socket terminals.

The spring portions disposed above the contact members are retained by spring portion supports formed to be stand vertically and be in relative alignment with a flat surface of the wedge portion of the lamp. The spring portion support has its lower portion connected to a lower portion of the contact member.

According to a first embodiment, there is incorporated at the upper end of the spring portion a connecting member, to which an external lead wire is connected or with which wiring on the printed circuit board contacts.

According to a second embodiment, there is provided a clamping member for clamping and fixing a metal wire core of an external cord and a coating thereof in order that the external cord may be directly mounted on the lower ends of the socket terminals.

While the provision of the spring portions in the present invention provides a guide in fixedly inserting the wedge base electric lamp and also allows the electric lamp to be inserted in position to assure adequate electrical contact, other advantages and features of the present invention will be appreciated in consideration of the ensuing detailed description of the present invention when taken in conjunction with the accompanying drawings.

DETAILED DESCRIPTION

Figure 1:
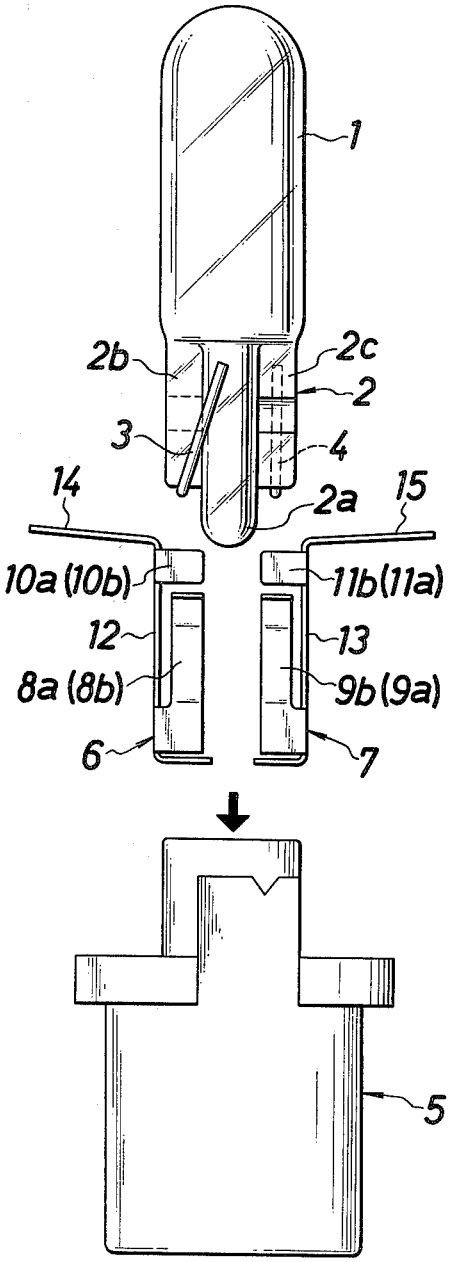
FIG. 1 is a side view of a pair of terminals socket separated from a socket body in a first embodiment in accordance with the present invention.

The present invention provides socket terminals, which are designed so that even if lead wires exiting from a wedge base portion of a wedge base electric lamp are misaligned, they assume normal position when the electric lamp is fixedly inserted.

The socket terminals for a wedge base electric lamp in accordance with the present invention are characterized in that the socket terminals can be contacted with lead wires of the electric lamp, and at the same time, there is provided a pair of spring-biased contact members serving as a retainer for the electric lamp, above which is provided a separate pair of inwardly curved spring portions in the holding mode. By the provision of the separate pair of spring portions disposed above the pair of spring-biased contact members, even if the lead wires of an electric lamp to be inserted are misaligned (towards the exhaust tube of the wedge base), the position of the lead wires may be corrected to their normal position during the course of insertion of the lamp, thereby avoiding occurrence of inferior contact.

Referring to the drawings, which illustrate salient features of the preferred embodiments of the invention, lead wires 3 and 4 exit from a sealed portion or wedge portion 2 of a wedge base electric lamp 1, the lead wires being respectively bent in opposite directions at the wedge portion 2 to form electrodes. The wedge portion 2 has at its center an exhaust tube portion 2*a*.

A socket on which the wedge base electric lamp 1 is mounted comprises a socket body 5 and a pair of socket terminals 6 and 7 fixedly inserted and mounted within the socket body. The present invention is particularly concerned with these socket terminals. These socket terminals have pairs of oppositely disposed contact members 8*a*, 8*b*, 9*a* and 9*b*, above which are disposed pairs of inwardly curved spring portions 10*a*, 10*b*, 11*a* and 11*b* in the holding mode. These spring portions 10*a*, 10*b*, 11*a* and 11*b* are positioned above the contact members, when the wedge base electric lamp 1 is fixedly inserted. Spring portion supports 12 and 13 stand vertically and align with a flat vertical surface of the wedge portion 2 of the lamp. The spring supports 12, 13 have ends thereof connected to ends of the contact members. Further, the spring portion supports 12, 13 are provided at the upper ends thereof with connecting members 14 and 15 to which external lead wires are connected or on which wiring on the printed circuit board bears.

The thus formed socket terminals 6 and 7 are fixedly inserted and mounted in the socket body 5 in a conventional manner. When the wedge base electric lamp 1 is fixedly inserted into the assembled socket, the contact members 8*a*, 8*b*, 9*a* and 9*b* are brought to bear on opposite sides of flat surface 2*b* and 2*c*, respectively, of the wedge portion 2 to hold the electric lamp therebetween, and the lead wires 3 and 4 are brought to bear on the contact members 8*a* and 9*b*, respectively, to provide electrical connections.

Figure 2:
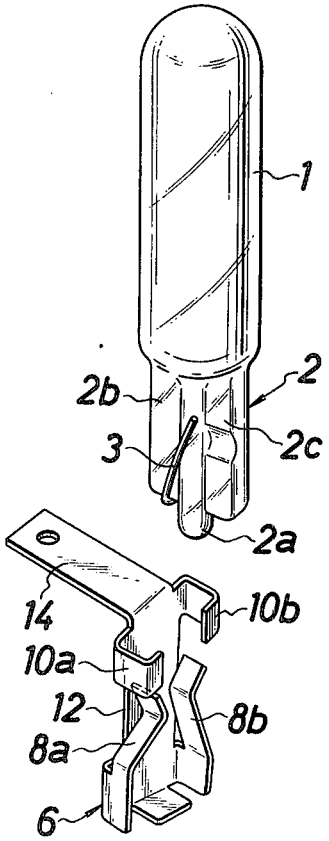
FIG. 2 is a perspective view showing one of the socket terminals in accordance with the present invention.
Figure 3:
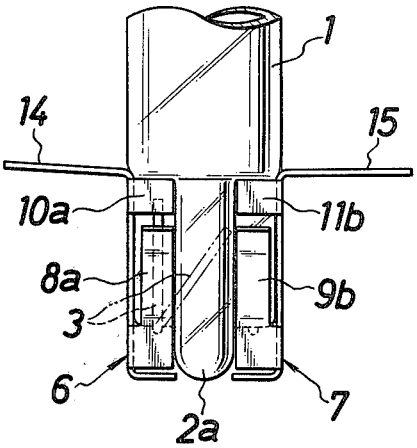
FIG. 3 is a side view showing a state of connection between the socket terminals according to the present invention and an electric lamp.

In this case, if one lead wire 3 is misaligned, for example, bent to be one-sided towards the exhaust tube 2*a* as shown in FIG. 2, the foremost end of the spring portion 10*a* bears on a border between the flat surface 2*b* of the wedge portion and the exhaust tube 2*a* when the electric lamp is fixedly inserted, to serve as a guide in inserting the lamp and to move the misaligned lead wire 3 from its misaligned position shown by dash-dotted contour lines in FIG. 3 to its proper position, as a consequence of which the lead wire now assuming a normal position may positively contact with the contact member 8*a* located thereunder.

Figure 4:
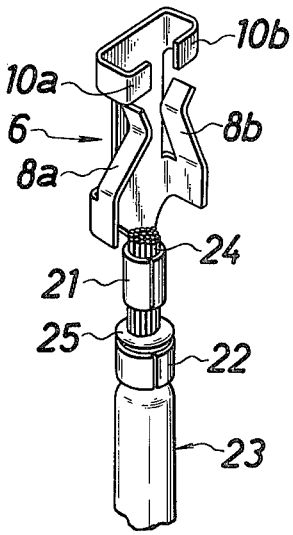
FIG. 4 is a perspective view of one of the socket terminals in a second embodiment.

In a further preferred embodiment shown in FIG. 4, there is illustrated a construction in which an external cord may be directly mounted on the lower end of the socket terminal. It will be noted that those portions other than the cord mounting section are identical to the first embodiment previously described. That is, in one socket terminal 6, above the contact members 8*a* and 8*b* are disposed spring portions 10*a* and 10*b*, the contact members and spring portions having the same function as those described in the first embodiment. At the lower end of the socket terminal 6 there are provided a conductive clamping member 21 as a cord mounting member for clamping a metal wire core 24 and a fixing and clamping member 22 for clamping and fixing a wires coating 25. Metal wires 24 in an external cord 23 and a coating 25 formed of vinyl or the like may be respectively clamped to thereby insure connection with the external cord to provide energization. Similar to the first embodiment, the socket terminal in the second embodiment also has spring portions 10*a* and 10*b* above contact members 8*a* and 8*b*. Accordingly, when the electric lamp is incorporated within the socket body similar to that shown in the first embodiment and fixedly inserted by the use of a pair of socket terminals, misalignment the lead wire in the electric lamp may be corrected when the lamp is fixedly inserted.

As described above, the socket terminals for a wedge base electric lamp in accordance with the present invention have a pair of spring portions above a pair of contact members, the spring portions formed to stand substantially vertically and align with flat surface of a wedge portion of the electric lamp. With this arrangement, even if the turned-up lead wires in the wedge base electric lamp are misaligned the position of the lead wires may be corrected by either the root of the spring portions or the foremost ends thereof to insure adequate contact between the contact members and the lead wires to positively hold the electric lamp and effect energization. As a result, it is possible to avoid occurrence of inconveniences such as non-operation of the lamp due to poor contact or flickering due to external vibrations, as present in lamps of the prior art. In the present invention, the spring portions also serve to guide the wedge base electric lamp when the latter is fixedly inserted so that the lamp may be accurately inserted into the adequate position.

While certain embodiments of the invention have been described in detail, it is understood that various modifications and other embodiments thereof may be devised by one skilled in the art without departing from the spirit and the scope of the invention, as defined by the claims.

What is claimed is:

1. A socket terminal (6) for mounting and making electrical contact to a wedge base electric lamp (11) having at least one lead wire (3, 4) exiting from the wedge base (2) of said wedge base electric lamp and running substantially along a surface (2*b*) of said wedge base (2).

said socket terminal (6) comprising:

contact means including at least a pair of opposed springy electrically conducting contact members (8*a*, 8*b*) which are spring-biased toward each other for electrically contacting said at least one lead wire (3, 4) and for engaging said wedge base (2) of said lamp between said pair of opposed contact members (8*a*, 8*b*) for holding said lamp in said socket terminal, each contact means having a bent retaining portion for engaging a recess on the wedge base of said wedge base lamp to retain said wedge base lamp in said socket terminal;

at least a pair of opposed, electrically conducting, generally U-shaped for spring members (10*a*, 10*b*) integral with, located above and spaced from said contact members (8*a*, 8*b*) in the direction of insertion of said wedge base lamp and in alignment with said contact members, said generally U-shaped spring members being arranged with the open part of the U-shape facing each other and being positioned so that upon insertion of said wedge base electric lamp into said socket terminal (6), at least one leg of each of said generally U-shaped spring members engages respective opposite surfaces of said wedge base (2) and at least one leg of at least one of said generally U-shaped spring members springingly engages a lead wire (3, 4) to align said lead wire so that it contacts at least one of said contact members (8*a*, 8*b*) upon further insertion of said wedge base of said lamp into said socket terminal, thereby assuring electrical contact between said at least one lead wire (3, 4) and at least one of said contact members (8*a*, 8*b*) and securing said wedge base electric lamp in said socket terminal.

2. The socket terminal of claim 1 wherein said generally U-shaped spring members (10*a*, 10*b*) are electrically connected with a pair of opposed spring-biased contact members (8*a*, 8*b*) of said contact means.

3. The socket terminal of claim 2 further comprising connecting means (14) located above said generally U-shaped spring members (10*a*, 10*b*) for making an external electrical connection to said socket terminal.

4. The socket terminal of claim 3 wherein said connecting member (14) extends substantially perpendicularly to said contact means and spring members so as to extend substantially parallel to a printed circuit board upon insertion of said socket terminal into an aperture of a printed circuit board, whereby upon insertion of said socket terminal into said aperture in a printed circuit board said at least one connecting member (14) bears against said printed circuit board to prevent further insertion of said socket terminal into said aperture.

5. The socket terminal of claim 2 further comprising connection means (14, 15; 21) electrically connected with said contact means for connecting an external electrical conductor to said contact means.

6. The socket terminal of claim 5 wherein said connecting means comprises a conductive clamping member (21) fixedly and electrically connected to said contact means at the lower end of said contact means.

7. The socket terminal of claim 6 wherein said clamping member comprises a secondary clamping element for clamping to an insulating coating of an electrical conductor.

8. The socket terminal of claim 1 wherein said contact means and generally U-shaped spring members are integrally formed of a springy metal material, said springy metal material comprising a substantially flat metallic portion (12) extending between said contact means and said substantially U-shaped spring members, and a stop means located below said contact members in the direction of insertion of said wedge base lamp for limiting the insertion distance of said wedge base into said socket terminal.

9. The socket terminal of claim 8 further comprising a pair of said contact means and associated generally U-shaped spring members located opposite each other for received opposing ends of said wedge base.

10. The socket terminal of claim 8 wherein said generally U-shaped spring members comprise leg portions and a bridging member extending between said leg portions, the length of said leg portions being greater than the diameter of said at least one lead wire (3, 4) of said wedge base lamp.

* * * * *